US007178633B2

(12) United States Patent
Angotti

(10) Patent No.: US 7,178,633 B2
(45) Date of Patent: Feb. 20, 2007

(54) PLATFORM EXTENSION AND HOLDER FOR A LADDER

(75) Inventor: Michael A. Angotti, 3440 S. Ocean Blvd., Unit 104S, Palm Beach, FL (US) 33480

(73) Assignees: Michael A. Angotti, Palm Beach, FL (US); Ann Angotti, Palm Beach, FL (US)

( * ) Notice: Subject to any disclaimer, the term of this patent is extended or adjusted under 35 U.S.C. 154(b) by 177 days.

(21) Appl. No.: 10/932,793

(22) Filed: Sep. 2, 2004

(65) Prior Publication Data

US 2006/0042876 A1 Mar. 2, 2006

(51) Int. Cl.
*E06C 7/00* (2006.01)

(52) U.S. Cl. ..... 182/129; 248/210

(58) Field of Classification Search ..... 182/129; 248/210, 238; D25/68
See application file for complete search history.

(56) References Cited

U.S. PATENT DOCUMENTS

| | | | | | |
|---|---|---|---|---|---|
| 2,554,120 | A * | 5/1951 | Pisano | 248/238 |
| 2,882,003 | A * | 4/1959 | Stiffler | 248/238 |
| 2,911,133 | A * | 11/1959 | Ruggieri | 182/129 |
| 2,982,982 | A * | 5/1961 | Swift, Sr. | 15/257.06 |
| 3,642,239 | A * | 2/1972 | Zeiler, Jr. | 248/210 |
| D273,364 | S * | 4/1984 | Brownlee, Jr. | D25/68 |
| 4,472,090 | A * | 9/1984 | Krings | 405/272 |
| 5,613,574 | A * | 3/1997 | Melanson | 182/129 |
| 5,673,885 | A * | 10/1997 | Pham | 248/210 |
| 6,341,666 | B1 * | 1/2002 | Allen | 182/129 |

* cited by examiner

*Primary Examiner*—Alvin Chin-Shue
(74) *Attorney, Agent, or Firm*—Howard M. Gitten; Edwards Angell Palmer & Dodge LLP

(57) ABSTRACT

A platform extension for securing items to a ladder, said platform extension comprising a substantially planar substrate; a wall extending from a first surface of said substrate, said wall being disposed in a substantially circumscribing shape; and an anchor for anchoring said substrate to a ladder.

6 Claims, 5 Drawing Sheets

PLATFORM EXTENSION AND HOLDER FOR A LADDER

BACKGROUND OF THE INVENTION

This invention is directed to a platform extension for a ladder, and more particularly, for a platform extension for stably holding tools, paint cans and the like when resting on a ladder.

A-frame ladders have been known for decades. They have become one of the staple tools for doing any activity which is performed at a height, yet requires a stable base. These activities include household repair, painting, construction, or the like. The most common version of the A-frame ladder includes a top, a first side having steps contained therein is connected to the top. A support, connected at the top platform, and separated from the steps across an acute angle to form an A with the step structure. The top of the A-frame ladder usually forms a platform upon which tools, paint cans or the like may rest.

The top platform is limited in area. Therefore, it is known to provide a secondary rotatably mounted to the support of the ladder near the top of the ladder. A person standing on the steps can reach over the top and access the platform extending from the support side of the ladder.

Ladders have been satisfactory, however they suffer from the deficiency that the platforms are limited in their stability so that if the ladder is jostled or moved while an item is resting on either the top or the platform of the ladder, it has a tendency to fall off the ladder. Furthermore, the size of the platform and top are limited. Accordingly, when performing a task that requires constant movement of the ladder, such as painting a larger area, such as the interior of the house, or fixing wiring which extends along a wall, all of the tools must be removed from the ladder each time the ladder is repositioned, otherwise they tend to fall off. This repetitive carrying of tools up and down the ladder results in a waste of time, and with heavy tools, can become a tiring unnecessary chore. Furthermore, because the user must carry the tools or paint can while ascending or descending the ladder, the user cannot use their hands; an unsafe condition.

Accordingly, a device for overcoming the shortcomings of A-frame ladders is desired.

BRIEF SUMMARY OF THE INVENTION

A platform extension and holder includes a substantially planar substrate. A wall extending from the substrate forms a substantially self-enclosed, open-topped structure on a first side of the platform. An anchor anchors the substrate to the ladder.

In a preferred embodiment, the container is an open-top cylinder dimensioned to receive a can of paint. The anchor cooperates with a step of the ladder for anchoring the platform to a ladder top.

In another embodiment of the invention, the anchor cooperates with the rotatable platform of the ladder and is secured on the rotatable platform of the ladder.

BRIEF DESCRIPTION OF THE DRAWINGS

For a fuller understanding of the invention, reference is had to the following description, taken in connection with the accompanying drawings, which are not drawn to scale, in which.

DETAILED DESCRIPTION OF THE PREFERRED EMBODIMENTS

Figure 1:
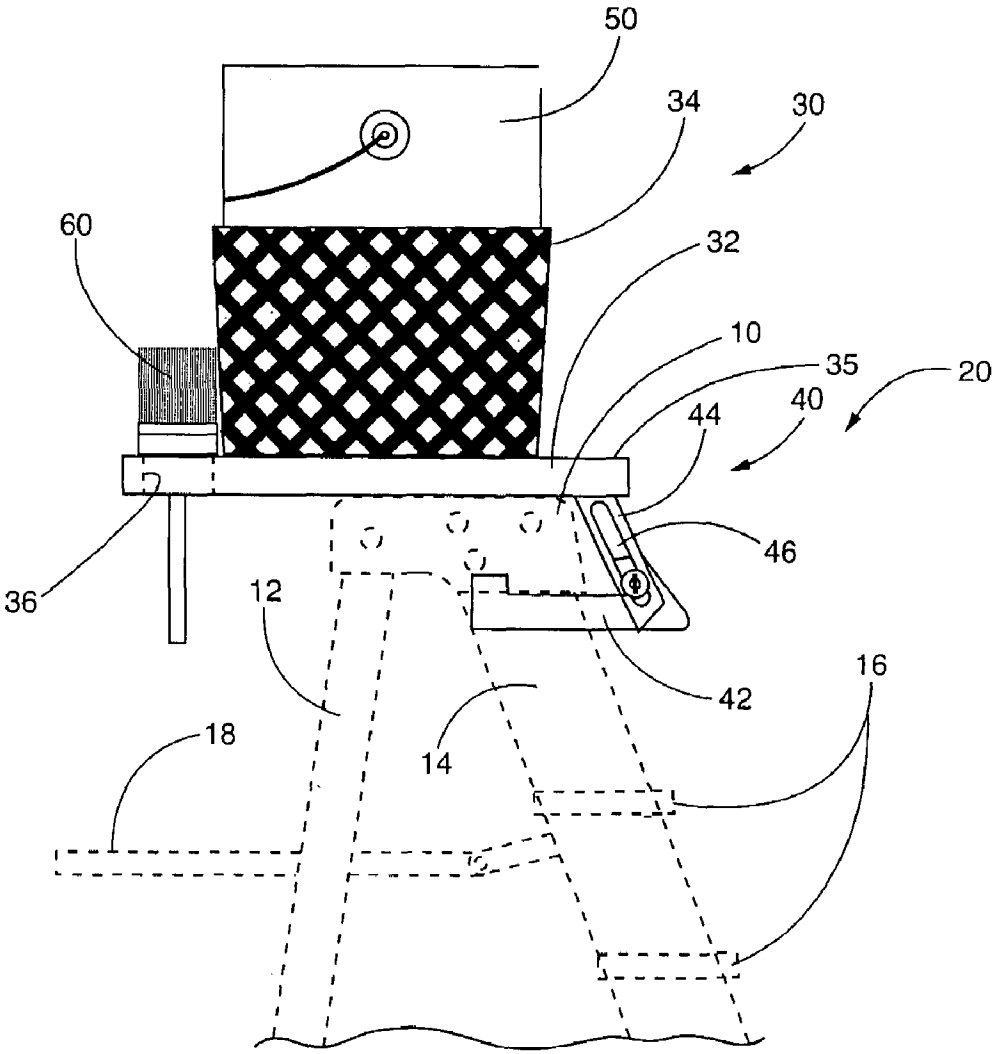
FIG. 1 is a side elevational view of a platform extension constructed in accordance with the invention.

Reference is made to FIG. 1 in which an A-frame ladder, generally indicated as 20, which does not comprise part of the invention, includes a top 10. A support member 12 extends from top 10, and a step member 14 extends from top 10 spaced from and at an angle from support member 12 to substantially form an A-shape. Step member 14 includes a plurality of steps 16 disposed therein. A platform 18 is rotatable affixed to support member 12.

Figure 2:
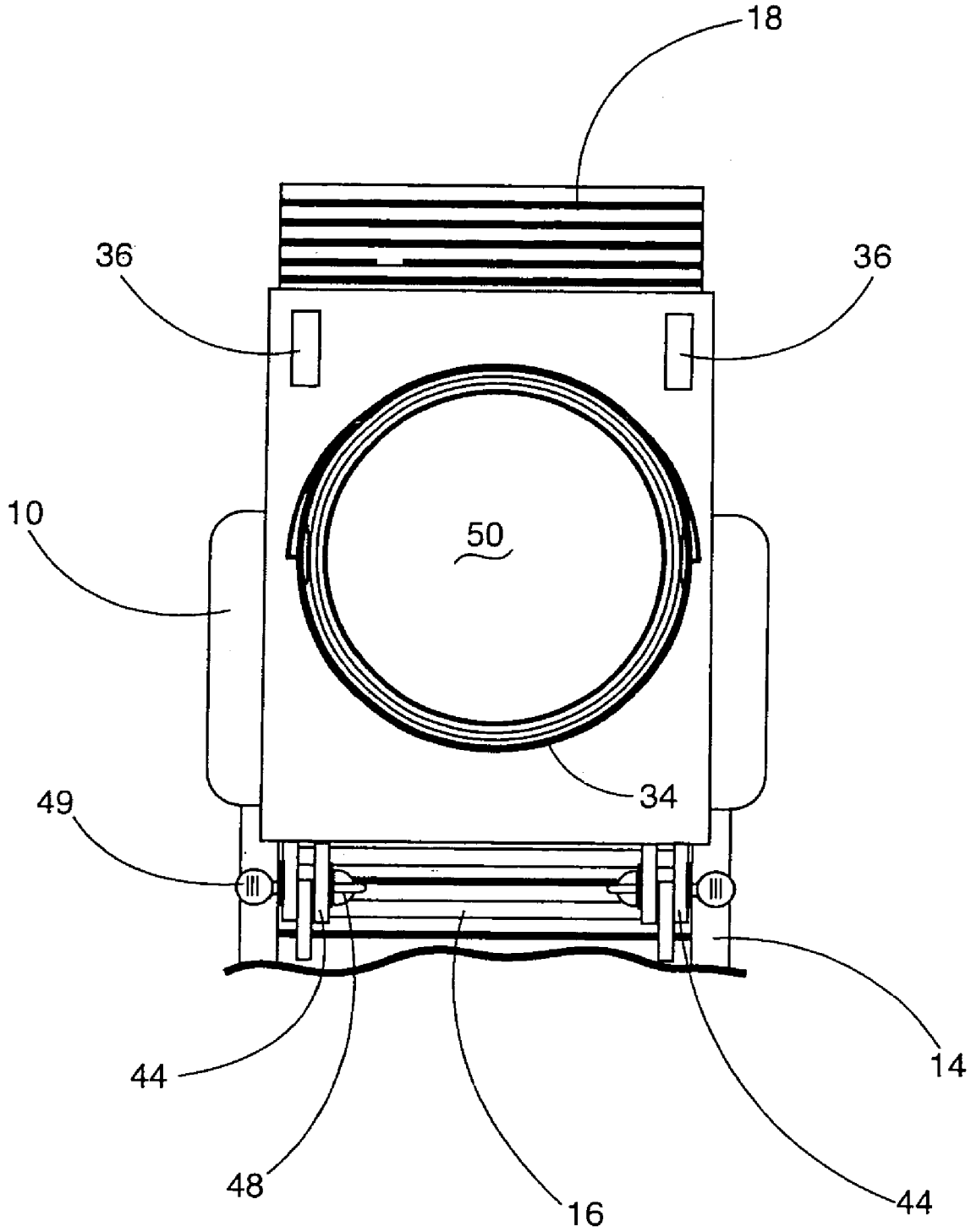
FIG. 2 is a top plan view of a platform extension constructed in accordance with the invention.

Platform extension, generally indicated as 30, includes a substantially planar substrate 32. A wall 34 is disposed on substrate 32 and extends from a top surface 35 thereof. Wall 34 forms an open-topped, substantially enclosed container (FIG. 2). An anchor 40 connected to planar substrate 32 anchors planar substrate 32 to ladder 20.

In a preferred embodiment, container 34 is integrally formed with substrate 32 and may, by way of non-limiting example, be formed of plastic. However, it should be understood that extension 30 may be formed of a lightweight metal such as aluminum or the like or any other lightweight, rigid, durable material. To save weight, wall 34 may be formed as a honey-combed construction as shown in FIG. 1.

Planar substrate 32, in a preferred, but not limiting embodiment, has a length and/or width greater than a length and/or width of ladder top 10 to provide a larger and more stable support platform for wall 34 and whatever may be contained therein. Furthermore, wall 34 is formed as a sidewall extending from substrate 32 and in a preferred embodiment provides a circumscribing structure as seen in FIG. 2 to act as a container. However, wall container 34 need only extend sufficiently to steadily hold the contents within wall 34. Wall 34 may be utilized to hold tools, such as hammer, wrench, screwdriver, nuts, bolts and nails. In such an instance, wall 35 would preferably be formed as a solid wall as opposed to honey-combed.

If being used to hold a paint container, wall 34 is sized and shaped to slideably receive and retain a paint can therein. The distance between wall 34 and a paint can 50 contained therein should be sufficiently small to allow paint can 50 to easily slide from wall 34, yet prevent paint can 50 from rocking, sliding or falling out of wall 34 during movement of ladder 10. Furthermore, in a preferred embodiment the height of wall 34 should be at least as high as one-third to half the height of paint can 50 which is received therein to retain paint can 50 therein during movement of ladder 10.

In a preferred embodiment, when used to hold a paint can, substrate 32 may also include slots 36 formed therein capable of receiving a tool such as a paint brush 60, a hammer, or even dimensioned to receive a screwdriver or wrench without the tool passing therethrough. In this way, a user of ladder 20 need not climb the ladder with hands full of tools, paint cans or the like facilitating quick, efficient movement of the ladder and safer ascending and descending of the ladder.

In the preferred embodiment, anchor 40 includes a substantially C-shaped member 42 connected to substrate 32 at one end and adapted to catch top 10 at another end. In this manner, C-shaped member 42 connects substrate 32 to top 10 and anchors it thereto. To accommodate a variety of different sized ladders, C-shaped member 42 is adjustably connected to substrate 32.

In a preferred embodiment, substrate 32 includes a flange 44 having a slot 46 therein. A nut 48 and bolt 49 combination passes through C-shaped clamp 42 at slot 46 such that bolt 48 travels within slot 46 of flange 44. In this way, C-shaped member 42 can effectively be lengthened or shortened relative to substrate 32 and the size of top 10 by bolt 49 riding through slot 46 and being tightened in the appropriate position, i.e., the position at which C-shaped clamp 42 engages top 10.

It should be noted, that anchor 40 can be formed by any structure which applies a force to bring substrate 32 towards top 10. C-member 42 may be replaced with a hook, a strap extending from substrate 32, a bungee cord, a rope or the like. As a result, anchor 40 is adjustable to accommodate a variety of ladder sizes.

Figure 3:
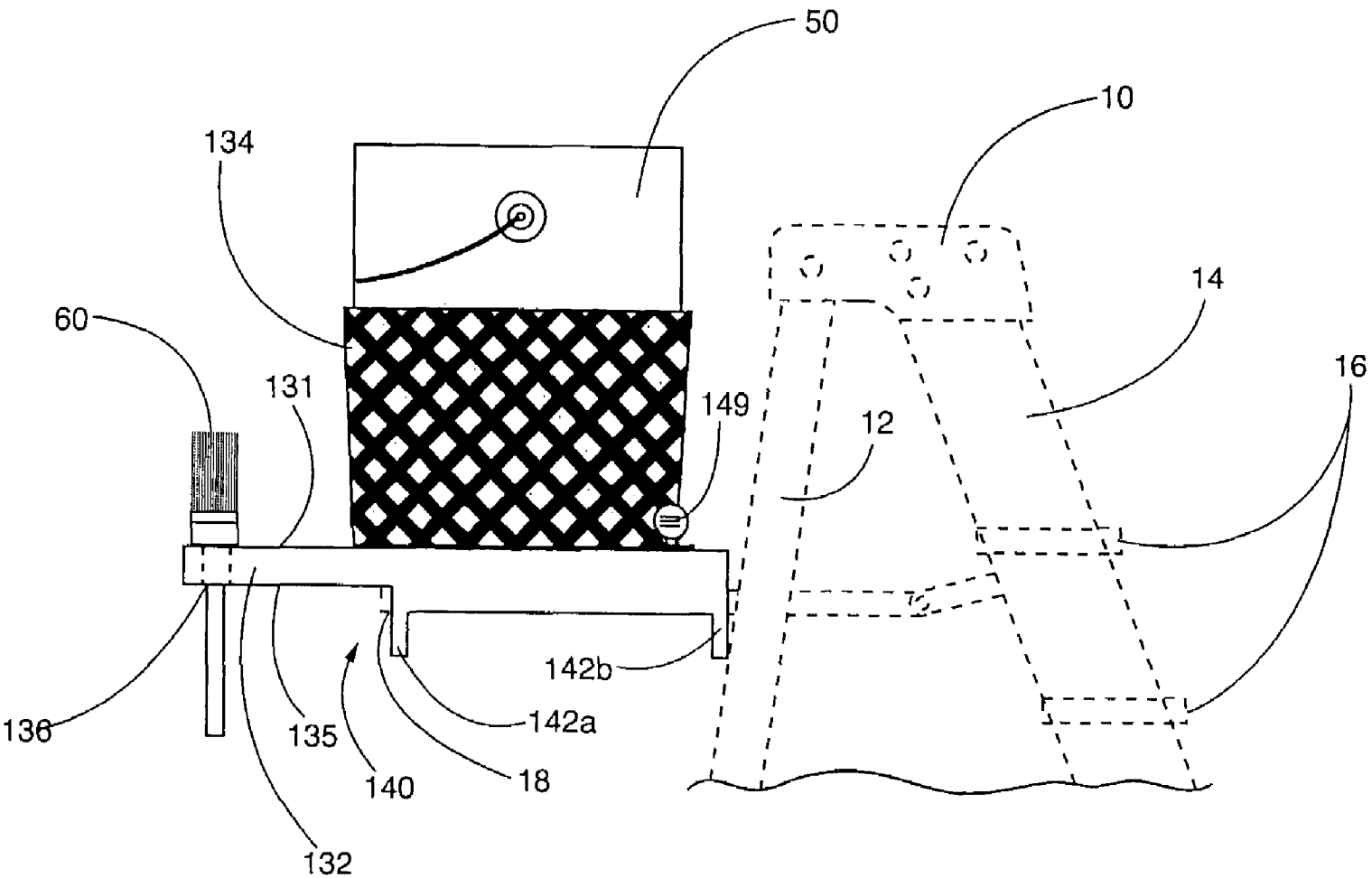
FIG. 3 is a side elevational view of a platform extension constructed in accordance with a second embodiment of the invention
Figure 4:
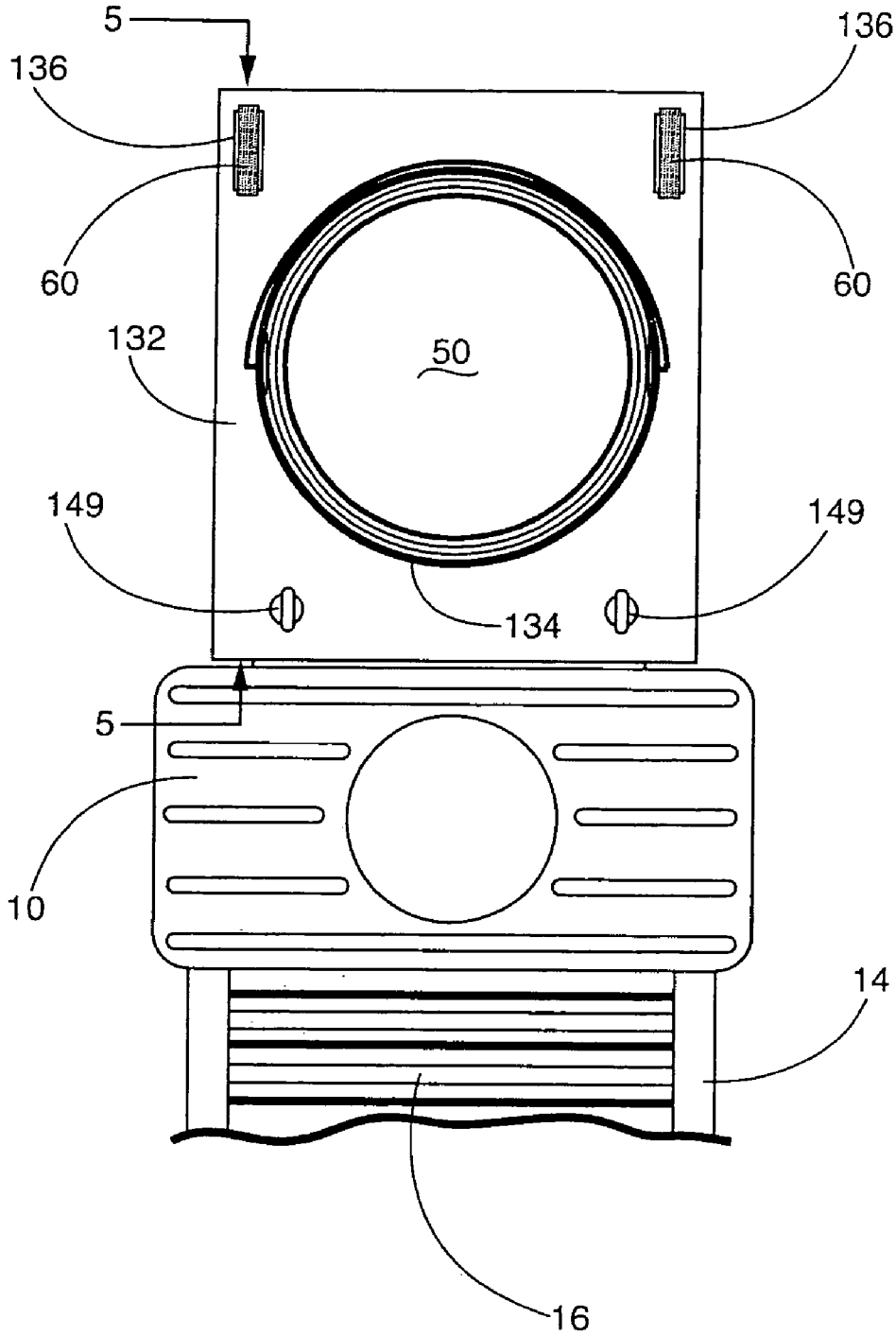
FIG. 4 is top plan view of a platform extension constructed in accordance with the second embodiment of the invention.
Figure 5:
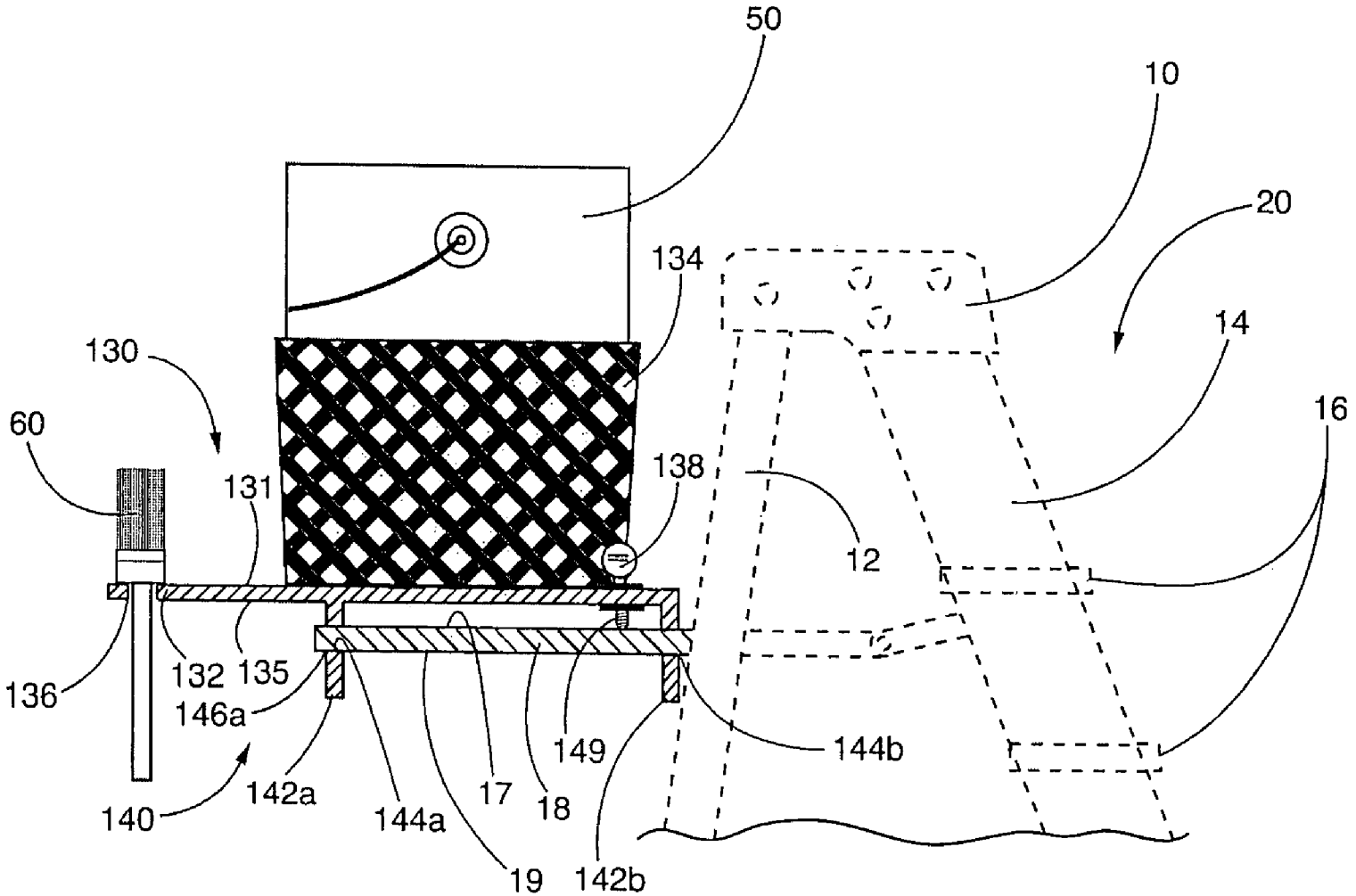
FIG. 5 is a sectional view taken along line 5—5 of FIG. 4.

It should be noted, that the illustrations in FIGS. 1 and 2 are by way of example only. The wall 34 of container of this embodiment as well as the embodiment of FIGS. 3-5 described below, when solid, can also contain the liquid directly without the need for a can. Furthermore, wall 34, as discussed above, can be sized to receive any can. However, an adaptor can be inserted within wall 34 to accommodate smaller diameter cans than can 50. In this way, a single platform could accommodate a half-gallon can as well as a quart can.

Platform extension 130 includes a substantially planar substrate 132. A wall 134 extends from a top surface 131 of substrate 132. Wall 134 forms a substantially circumscribed shape and may be sized and shaped to receive a paint can as described above. However, in other embodiments in which extension 130 is being utilized to hold tools such as nails, nuts, bolts or hooks, the circumscribed shape can be of any necessary size. Again, wall 134 may be formed of a honeycombed pattern to save on weight and material. However, it can be formed solidly. Additionally, it may be integrally formed with substrate 132, or may be removably attached by Velcro® fasteners, snaps, hooks or the like as known in the art.

In a preferred embodiment substrate 132 is greater in at least one dimension, such as length, or width than platform 18 to which it is attached. Because, as in this example, substrate 132 has a length greater than that of platform 18, slots 136 may be formed in substrate 132 for receiving tools therein, such as paint brush 60 by way of example or a hammer, screwdriver, wrench or the like.

An anchor, for attaching to ladder 20 connects substrate 132 to platform 18. Anchor 140 is a structure adapted to receive platform 18 therein and to secure itself to platform 18. Anchor 140 includes at least a first member 142*a* extending from a bottom surface 135 of substrate 132; a direction opposed to the direction of extension of wall 134. Member 142*a* is formed with a slot 146*a* therein, sized and dimensioned to receive platform 18 therethrough. Slot 146*a* includes at least a bottom surface 144*a*.

A threaded bolt 149 extends through and cooperates with a threaded opening 138 of substrate 132. Threaded bolt 149 has a length sufficient to come into pressing contact with platform 18 when threaded bolt 149 is disposed within threaded opening 138.

A second descending member, 142*b* has a slot 146*b* formed therein having a bottom surface 144*a*. Slot 146*b* also receives platform 18.

During use, extension 130 is placed onto platform 18, by platform 18 being received in slots 146*a*, 146*b*. Screws 149 are tightened against a top surface 17 of platform 18 effectively raising substrate 132 relative to platform 18. As a result, a bottom surface 19 of platform 18 comes in contact with a bottom surface 144*a*, 144*b* of respective depending members 142*a*, 142*b* so that platform 18 is pinned between bolt 149 and the bottom surface 146 of a respective slot 146.

Again, anchor 140 can be substituted with a hook mechanism, strap mechanism, or any other substitute which affixes substrate 132 to platform 18.

By providing a platform having a wall which essentially forms a container thereon and anchoring the platform to a portion of the ladder, a device/adaptor is provided which maintains objects being used during a project, such as paint cans, paint brushes, tools, nuts and bolts on the ladder, while the ladder is being repositioned from one location to another. As a result, work is done more efficiently as it is no longer necessary to remove everything from the ladder when repositioning it. Tools, paint, etc. are more stably maintained on the ladder during the job, and safer work is performed as the user of the ladder no longer has to repeatedly climb up and down the ladder with tools, paint and the like in their hands.

Thus, while there have been shown, described and pointed out novel features of the present invention as applied to preferred embodiments thereof, it will be understood that various omissions and substitutions in changing the form and details of the disclosed invention may be made by those skilled in the art without departing from the spirit and scope of the invention. It is the intention, therefore, to be limited only as indicated by the scope of the claims appended hereto. It is also to be understood that the following claims are intended to cover all of the generic and specific features of the invention herein described and all statements of the scope of the invention, which, as a matter of language, might be said to fall therebetween.

What is claimed as new and desired to be protected by Letters Patent of the United States is:

1. A platform extension for securing items to a ladder, said platform extension comprising:

a substantially planar substrate;

a wall extending upwardly from a top surface of said substrate, said wall being formed in a substantially circumscribing shape; and an anchor for anchoring said substrate to a ladder, said anchor includes a substantially planar member depending from said substrate and forming a L-shape with said substrate, said depending member having a closed slot extending through the plane of said depending and adapted to receive a platform extending from the ladder, a bolt adjustably connected to said substrate, adjustable in a direction substantially through a plane of the substrate between a first position not contacting a ladder and a second position contacting a ladder to secure the substrate against the ladder, said slot having a bottom surface, and when said bolt is in said second position, said bottom surface of said slot contacts the platform.

2. The extension of claim 1, wherein said wall is integrally formed with said substrate.

3. The extension of claim 1, wherein said substrate is greater in at least one dimension than a top of a ladder to which said platform is affixed.

4. The extension of claim 3, further comprising a slot formed through said substrate.

5. The extension of claim 1, wherein said wall is formed in a circumscribed shape that is sized and adapted to slideably receive a paint can therein.

6. The extension of claim 1, wherein said wall, substrate and depending member are formed as a unitary construction.

* * * * *